US009393810B2

(12) United States Patent
Aoyama

(10) Patent No.: US 9,393,810 B2
(45) Date of Patent: Jul. 19, 2016

(54) LIQUID EJECTING APPARATUS

(71) Applicant: SEIKO EPSON CORPORATION, Tokyo (JP)

(72) Inventor: Mitsuteru Aoyama, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/522,894

(22) Filed: Oct. 24, 2014

(65) Prior Publication Data

US 2015/0124017 A1 May 7, 2015

(30) Foreign Application Priority Data

Nov. 1, 2013 (JP) ..... 2013-227951

(51) Int. Cl.
*B41J 11/00* (2006.01)

(52) U.S. Cl.
CPC ..... *B41J 11/002* (2013.01)

(58) Field of Classification Search
CPC ..... B41J 11/002
USPC ..... 347/16, 19
See application file for complete search history.

(56) References Cited

U.S. PATENT DOCUMENTS

| | | | | |
|---|---|---|---|---|
| 2009/0167794 | A1 | 7/2009 | Hosono et al. | |
| 2011/0074857 | A1 * | 3/2011 | Mitsuzawa | B41J 11/002 347/16 |
| 2012/0287214 | A1 | 11/2012 | Fujisawa | |

FOREIGN PATENT DOCUMENTS

| | | |
|---|---|---|
| JP | 2004-188705 | 7/2004 |
| JP | 2005-193597 | 7/2005 |
| JP | 2005-219401 | 8/2005 |
| JP | 2005-313558 | 11/2005 |
| JP | 2006-021435 | 1/2006 |
| JP | 2009-160920 | 7/2009 |
| JP | 2010-280195 | 12/2010 |
| JP | 2012-051160 | 3/2012 |
| JP | 2012-236295 | 12/2012 |
| JP | 2013-010360 | 1/2013 |

* cited by examiner

*Primary Examiner* — Jason Uhlenhake
(74) *Attorney, Agent, or Firm* — Workman Nydegger

(57) ABSTRACT

When a medium is located immediately under a distance sensor in printing, a controller of a printer acquires a distance from the medium to a first irradiator and a second irradiator in a direction orthogonal to a relative movement direction in which the medium moves relative to a liquid ejecting head, on the basis of a detection signal from the distance sensor. On the basis of the distance, the controller changes relative positions of irradiation ranges irradiated with light from the first irradiator and the second irradiator on the medium so as to define relative positions of the irradiation ranges such that the degree of overlapping between the irradiation ranges and the distance between the irradiation ranges do not increase significantly.

9 Claims, 10 Drawing Sheets

LIQUID EJECTING APPARATUS

BACKGROUND

1. Technical Field

The present invention relates to a liquid ejecting apparatus.

2. Related Art

Typical liquid ejecting apparatus is an ink-jet printer that ejects photo-curing (e.g., UV-curing) liquid from a liquid ejecting head to a medium that moves relative to the liquid ejecting head and irradiates the medium with light (e.g., ultraviolet light) from a first light source and a second light source so that the liquid on the medium is cured (see, for example, JP-A-2009-160920).

SUMMARY

The thickness of a medium varies depending on the type of the medium. A variation in thickness of the medium changes the distance L from the medium to the first light source and the second light source in a liquid ejection direction when light is applied to the medium to which liquid has ejected from a liquid ejecting head. The change in distance L changes relative positions of an irradiation range A1 irradiated with light from the first light source and an irradiation range A2 irradiated with light from the second light source on the medium.

FIGS. 19 and 20 illustrate a change in the relative positions of the irradiation range A1 and the irradiation range A2 on the medium caused by a variation in the distance L. As the distance L increases, the distance between the irradiation range A1 and the irradiation range A2 decreases as illustrated in FIG. 19. On the other hand, as the distance L decreases, the distance between the irradiation range A1 and the irradiation range A2 increases as illustrated in FIG. 20. Thus, such a variation in distance L depending on the type of the medium increases the degree of overlapping between the irradiation ranges A1 and A2 and increases the distance between the irradiation ranges A1 and A2 on the medium.

The increased degree of overlapping between the irradiation ranges A1 and A2 and the increased distance between the irradiation ranges A1 and A2 on the medium might cause a density variation (banding) of cured liquid between a region showing the increased degree of overlapping or the increased distance and a region showing no such phenomena.

This density variation occurs not only in ink-jet printers using UV-curing ink but in most types of liquid ejecting apparatuses that eject photo-curing liquid.

An advantage of some aspects of the invention is to provide a liquid ejecting apparatus that can reduce occurrence of a density variation of photo-curing liquid that is cured on a medium.

The apparatus and advantages thereof will now be described.

A liquid ejecting apparatus according to an aspect of the invention includes: a liquid ejecting head that ejects photo-curing liquid; a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations; and a controller that changes relative positions of a light irradiation range on the medium irradiated with light from the first light source and a light irradiation range on the medium irradiated with light from the second light source, on the basis of a distance from the medium to the first light source and the second light source in the ejection direction.

With this configuration, when the medium onto which photo-curing liquid has been ejected from the liquid ejecting head is irradiated with light, the relative positions of the light irradiation range irradiated with light from the first light source and the light irradiation range irradiated with light from the second light source on the medium can be defined on the basis of the distance from the medium to the first light source and the second light source in the ejection direction such that the degree of overlapping between the irradiation ranges and the distance between the irradiation ranges do not increase. By defining the relative positions of the irradiation ranges on the medium in this manner, it is possible to reduce occurrence of a density variation of cured liquid between a region showing an increased degree of overlapping or an increased distance and a region showing no such phenomena.

A liquid ejecting apparatus according to another aspect of the invention includes: a liquid ejecting head that ejects photo-curing liquid; a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations; a driving unit that moves at least one of the first light source or the second light source in the ejection direction; and a controller that drives the driving unit on the basis of a distance from the medium to the first light source and the second light source in the ejection direction, thereby changing a position of the at least one of the first light source or the second light source relative to the medium in the ejection direction.

With this configuration, the position of at least one of the first light source or the second light source relative to the medium in the ejection direction is changed on the basis of the distance from the medium to the first light source and the second light source in the ejection direction, and thus, the relative positions of the light irradiation range irradiated with light from the first light source and the light irradiation range irradiated with light from the second light source on the medium can be defined as follows. That is, it is possible to define the relative positions of the irradiation ranges on the medium such that the degree of overlapping between the irradiation ranges and the distance between the irradiation ranges do not increase. By defining the relative positions of the irradiation ranges on the medium in this manner, it is possible to reduce occurrence of a density variation of cured liquid between a region showing an increased degree of overlapping or an increased distance and a region showing no such phenomena.

A liquid ejecting apparatus according to still another aspect of the invention includes: a liquid ejecting head that ejects photo-curing liquid; a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations; a driving unit that moves at least one of the first light source or the second light source in the direction intersecting the ejection direction; and a controller that drives the driving unit on the basis of a distance from the medium to the first light source and the second light source in the ejection direction, thereby changing a distance between the first light source and the second light source in the direction intersecting the ejection direction.

With this configuration, a change in distance between the first light source and the second light source in the direction intersecting the ejection direction changes the relative positions of the light irradiation range irradiated with light from the first light source and the light irradiation range irradiated with light from the second light source on the medium. Thus, when the medium to which photo-curing liquid has been ejected from the liquid ejecting head is irradiated with light, the distance between the first light source and the second light source in the direction intersecting the ejection direction on the basis of the distance from the medium to the first light source and the second light source in the ejection direction, and thus, the relative positions of the light irradiation range irradiated with light from the first light source and the light irradiation range irradiated with light from the second light source on the medium can be defined as follows. That is, it is possible to define the relative positions of the irradiation ranges on the medium such that the degree of overlapping between the irradiation ranges and the distance between the irradiation ranges do not increase. By defining the relative positions of the irradiation ranges on the medium in this manner, it is possible to reduce occurrence of a density variation of cured liquid between a region showing an increased degree of overlapping or an increased distance and a region showing no such phenomena.

A liquid ejecting apparatus according to yet another aspect of the invention includes: a liquid ejecting head that ejects photo-curing liquid; a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations; a driving unit that adjusts directivity of at least one of the first light source or the second light source; and a controller that drives the driving unit on the basis of a distance from the medium to the first light source and the second light source in the ejection direction, thereby changing a light application angle of the at least one of the first light source or the second light source.

With this configuration, adjustment of the directivity of at least one of the first light source or the second light source changes the light application angle of the light source whose directivity is adjusted, and thus, the relative positions of the light irradiation range irradiated with light from the first light source and the light irradiation range irradiated with light from the second light source on the medium is changed. Thus, when the medium onto which photo-curing liquid has been ejected from the liquid ejecting head is irradiated with light, the directivity of at least one of the first light source or the second light source is changed on the basis of the distance from the medium to the first light source and the second light source in the ejection direction, and thus, the relative positions of the light irradiation range irradiated with light from the first light source and the light irradiation range irradiated with light from the second light source on the medium can be defined as follows. That is, it is possible to define the relative positions of the irradiation ranges on the medium such that the degree of overlapping between the irradiation ranges and the distance between the irradiation ranges do not increase.

A liquid ejecting apparatus according to still another aspect of the invention includes: a liquid ejecting head that ejects photo-curing liquid; a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations; a driving unit that adjusts light emission of at least one of the first light source or the second light source; and a controller that drives the driving unit on the basis of a distance from the medium to the first light source and the second light source in the ejection direction, thereby changing a light-emission region of the at least one of the first light source or the second light source.

With this configuration, adjustment of light emission (i.e., a light-emission region) of at least one of the first light source or the second light source increases or reduces the light irradiation range irradiated with light from the light source whose light emission is adjusted. Thus, the relative positions of the light irradiation range irradiated with light from the first light source and the light irradiation range irradiated with light from the second light source on the medium can be changed. Specifically, when the medium to which photo-curing liquid has been ejected from the liquid ejecting head is irradiated with light, the light emission (i.e., a light-emission region) of at least one of the first light source or the second light source is adjusted on the basis of the distance from the medium to the first light source and the second light source in the ejection direction, and thus, the relative positions of the light irradiation range irradiated with light from the first light source and the light irradiation range irradiated with light from the second light source on the medium can be defined as follows. That is, it is possible to define the relative positions of the irradiation ranges on the medium such that the degree of overlapping between the irradiation ranges and the distance between the irradiation ranges do not increase. By defining the relative positions of the irradiation ranges on the medium in this manner, it is possible to reduce occurrence of a density variation of cured liquid between a region showing an increased degree of overlapping or an increased distance and a region showing no such phenomena.

The liquid ejecting apparatus may further include: a driving unit that moves at least one of the first light source or the second light source in the ejection direction. In this case, the controller drives the driving unit on the basis of a distance from the medium to the first light source and the second light source in the ejection direction so that a position of the at least one of the first light source or the second light source relative to the medium in the ejection direction is changed, thereby changing relative positions of the irradiation ranges on the medium.

The liquid ejecting apparatus may further include: a driving unit that moves at least one of the first light source or the second light source in a direction intersecting the ejection direction. In this case, the controller drives the driving unit on the basis of a distance from the medium to the first light source and the second light source in the ejection direction so that a distance between the first light source and the second light source in the direction intersecting the ejection direction is changed, thereby changing relative positions of the irradiation ranges on the medium.

The liquid ejecting apparatus may further include: a driving unit that adjusts directivity of at least one of the first light source or the second light source. In this case, the controller drives the driving unit on the basis of a distance from the medium to the first light source and the second light source in the ejection direction so that a light application angle of the at least one of the first light source or the second light source is changed, thereby changing relative positions of the irradiation ranges on the medium.

The liquid ejecting apparatus may further include: a driving unit that adjusts light emission of at least one of the first light source or the second light source. In this case, the controller drives the driving unit on the basis of a distance from the medium to the first light source and the second light source in the ejection direction so that a light-emission region of the at least one of the first light source or the second light source is changed, thereby changing relative positions of the irradiation ranges on the medium.

BRIEF DESCRIPTION OF THE DRAWINGS

The invention will be described with reference to the accompanying drawings, wherein like numbers reference like elements.

DESCRIPTION OF EXEMPLARY EMBODIMENTS

First Embodiment

A first embodiment showing an ink-jet printer as an implementation of a liquid ejecting apparatus will be described with reference to FIGS. 1 to 6.

Figure 1:
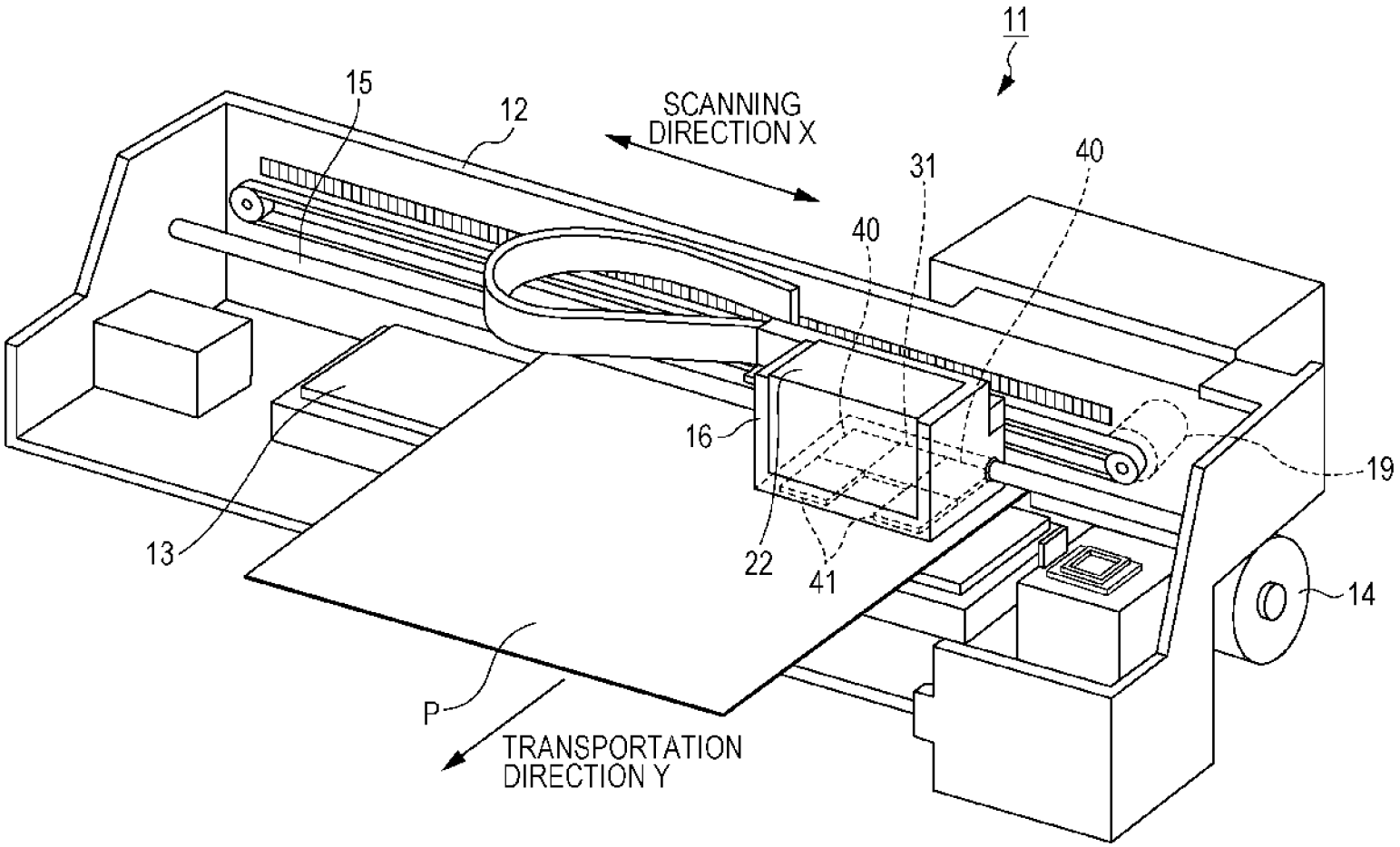
FIG. 1 is a perspective view illustrating a configuration of a printer according to an embodiment.

A printer 11 illustrated in FIG. 1 includes: a support 13 located at a lower portion in a body case 12; and a feeding motor 14 that is driven to feed a medium P such as paper in a transportation direction Y so that the medium P is sent to the support 13. The printer 11 further includes: a guide shaft 15 located above the support 13 in the body case 12 and extending in a scanning direction X orthogonal to the transportation direction Y; a carriage 16 supported by the guide shaft 15 such that the carriage 16 can reciprocate in the scanning direction X; and a carriage motor 19 that causes the carriage 16 to move along the guide shaft 15.

A liquid ejecting head 31 for ejecting ultraviolet (UV)-curing ink, which is an example of a photo-curing liquid, is provided on the lower surface of the carriage 16. When a medium P is fed onto the support 13 through driving of the feeding motor 14, the medium P moves in the transportation direction Y relative to the liquid ejecting head 31. The liquid ejecting head 31 is supplied with ink from an ink cartridge 22 attached to an upper portion of the carriage 16, and ejects the ink through an ejection nozzle to the medium P fed onto the support 13.

A first irradiator 40 serving as a first light source and a second irradiator 41 serving as a second light source are provided at the sides in the scanning direction X of the liquid ejecting head 31 on the lower surface of the carriage 16. The first irradiator 40 and the second irradiator 41 of the carriage 16 are parallel to each other in the transportation direction Y. The medium P is irradiated with apply from the first irradiator 40 and the second irradiator 41 UV at different locations in the transportation direction Y. The first irradiator 40 is located upstream of the second irradiator 41 in the transportation direction Y, applies a relatively weak UV so as to cause precuring (i.e., curing of the surface) of ink on the medium P that moves in the transportation direction Y relative to the liquid ejecting head 31. The second irradiator 41 applies UV stronger than UV from the first irradiator 40 so as to cause postcuring (curing of the inside) of the ink that has been precured by the UV application from the first irradiator 40.

Figure 2:
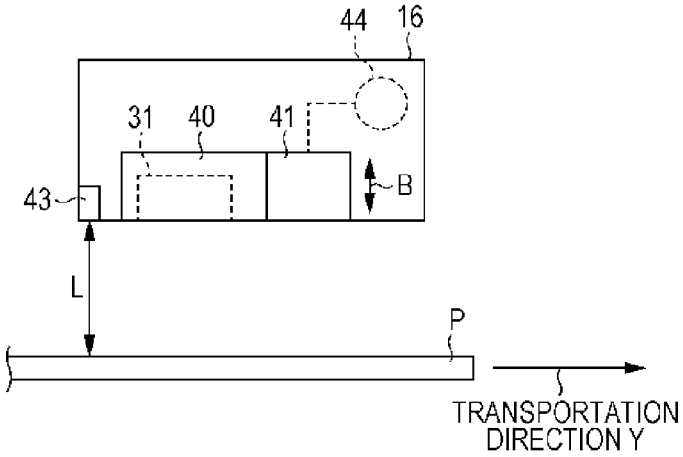
FIG. 2 schematically illustrates a configuration of a carriage.

As illustrated in FIG. 2, the carriage 16 includes a distance sensor 43 that detects a distance L from the medium P to the first and second irradiators 40 and 41 in a direction orthogonal to the transportation direction Y. The distance L is a distance from the medium P to the first and second irradiators 40 and 41 in an ejection direction in which ink is ejected from the liquid ejecting head 31 to the medium P. The transportation direction Y intersects the ejection direction, and the scanning direction X (see FIG. 1) also intersects the ejection direction.

The carriage 16 includes a driving unit 44 that causes the first irradiator 40 and the second irradiator 41 to move in the ejection direction. In this embodiment, the ejection direction in which the first irradiator 40 and the driving unit 44 are caused to move by the driving unit 44 will be referred to as a variable gap direction B.

The driving unit 44 includes a motor and a conversion mechanism (e.g., a rack and pinion) that causes a driving force of the motor to act on the first irradiator 40 and the second irradiator 41 in the variable gap direction B. Thus, the first irradiator 40 and the second irradiator 41 are allowed to move in the variable gap direction B through driving of the driving unit 44.

An electrical configuration of the printer 11 will now be described.

Figure 3:
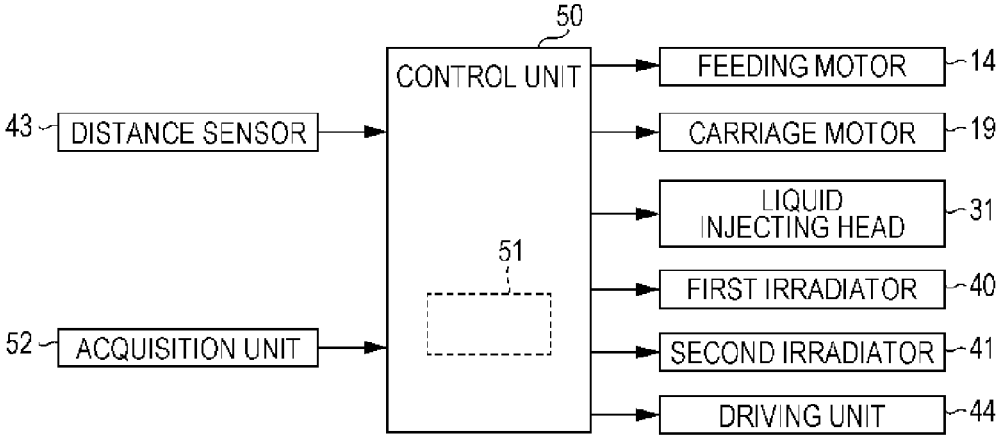
FIG. 3 is a block diagram illustrating an electrical configuration of the printer.

As illustrated in FIG. 3, the printer 11 includes a controller 50 that integrally controls the printer 11. An input circuit of the controller 50 is connected to the distance sensor 43 and an acquisition unit 52 that acquires information such as an ink type and a medium type set in the printer 11 from the user.

Examples of a unit such as the acquisition unit 52 include a personal computer connected to the printer 11 and an operation panel of the printer 11. The information such as an ink type and a medium type acquired from the acquisition unit 52 is stored in a memory section 51 in the controller 50.

An output circuit of the controller 50 is connected to the feeding motor 14, the carriage motor 19, the liquid ejecting head 31, the first irradiator 40, the second irradiator 41, and the driving unit 44. The controller 50 receives print job data from, for example, the personal computer connected to the printer 11, and controls print operation of the printer 11 on the basis of the data. Specifically, the controller 50 controls the feeding motor 14, the carriage motor 19, the liquid ejecting head 31, the first irradiator 40, the second irradiator 41, and the driving unit 44, which are responsible for print operation of the printer 11.

Through the control of the feeding motor 14, the medium P moves in the transportation direction Y and is fed onto the support 13. In addition, through the control of the carriage motor 19 and the liquid ejecting head 31, ink is ejected onto the medium P by the liquid ejecting head 31 while the carriage 16 is moving in the scanning direction X as necessary. Further, through the control of the first irradiator 40 and the second irradiator 41, the ink ejected onto the medium P is irradiated with UV, and thereby, is cured, thus performing printing on the medium P.

The distance L varies depending on the thickness of the medium P that differs among the types, and the relative positions of the irradiation range A1 irradiated with UV from the first irradiator 40 and the irradiation range A2 irradiated with UV from the second irradiator 41 on the medium P vary depending on the distance L. Thus, an increase in the degree of overlapping between the irradiation ranges A1 and A2 and an increase in the distance between the irradiation ranges A1 and A2 on the medium P might occur with some distances L. The increased degree of overlapping between the irradiation ranges A1 and A2 and the increased distance between the irradiation ranges A1 and A2 on the medium P might cause a density variation (banding) of cured ink between a region showing the increased degree of overlapping or the increased distance and a region showing no such phenomena.

Figure 4:
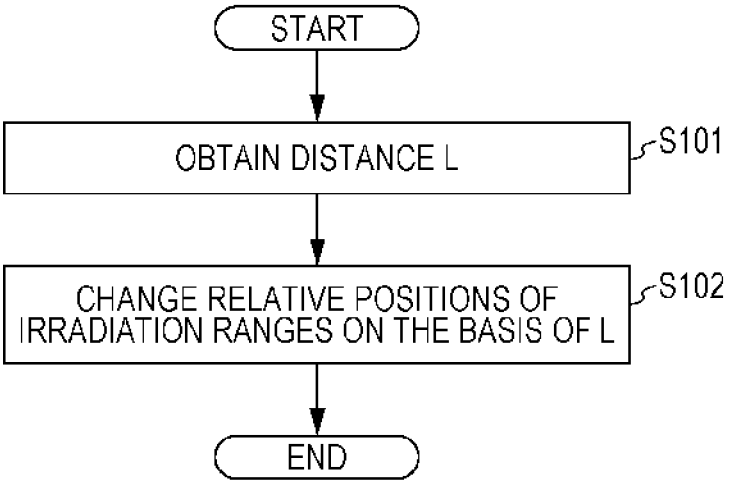
FIG. 4 is a flowchart showing processes of changing relative positions of UV irradiation ranges irradiated with UV from a first irradiator and a second irradiator.

FIG. 4 is a flowchart showing a process for reducing such phenomena. This process is performed by the controller 50 in printing. Specifically, in step 101 (S101), the controller 50 acquires the distance L on the basis of a detection signal from the distance sensor 43 when the medium P is located immediately under the distance sensor 43. Then, in step S102, on the basis of the acquired distance L, the controller 50 changes the relative positions of the irradiation ranges A1 and A2 on the medium P so as to define the relative positions of the irradiation ranges A1 and A2 such that an increase in the degree of overlapping between the irradiation ranges A1 and A2 and an increase in the distance between the irradiation ranges A1 and A2 can be reduced.

The relative positions of the irradiation ranges A1 and A2 herein are based on the positional relationship between the outer edge of the irradiation range A1 and the outer edge of the irradiation range A2. Thus, the centers or barycenters of the irradiation ranges A1 and A2 do not always change when the relative positions of the irradiation ranges A1 and A2 change.

The controller 50 obtains a driving instruction value of the driving unit 44 with reference to a map on the basis of the distance L, and based on the obtained driving instruction value, drives the driving unit 44 such that the first irradiator 40 and the second irradiator 41 move in the variable gap direction B, thereby changing the positions of the first irradiator 40 and the second irradiator 41 relative to the medium P on the support 13. By changing the positions of the first irradiator 40 and the second irradiator 41 relative to the medium P as described above, the relative positions of the irradiation ranges A1 and A2 on the medium P are changed. Thus, the driving instruction value obtained with reference to the map is used as a value for obtaining the relative positions of the irradiation ranges A1 and A2 at which the degree of overlapping between the irradiation ranges A1 and A2 and the distance between the irradiation ranges A1 and A2 do not increase.

Operation of the printer 11 will now be described.

On the basis of the distance L from the medium P to the first and second irradiators 40 and 41 in the variable gap direction B (i.e., the direction in which ink is ejected from the liquid ejecting head 31 onto the medium P), the relative positions of the irradiation ranges A1 and A2 irradiated with UV from the first irradiator 40 and the second irradiator 41 on the medium P are defined in the following manner. That is, the relative positions of the irradiation ranges A1 and A2 are defined such that the degree of overlapping between the irradiation ranges A1 and A2 and the distance between the irradiation ranges A1 and A2 do not increase.

Figure 5:
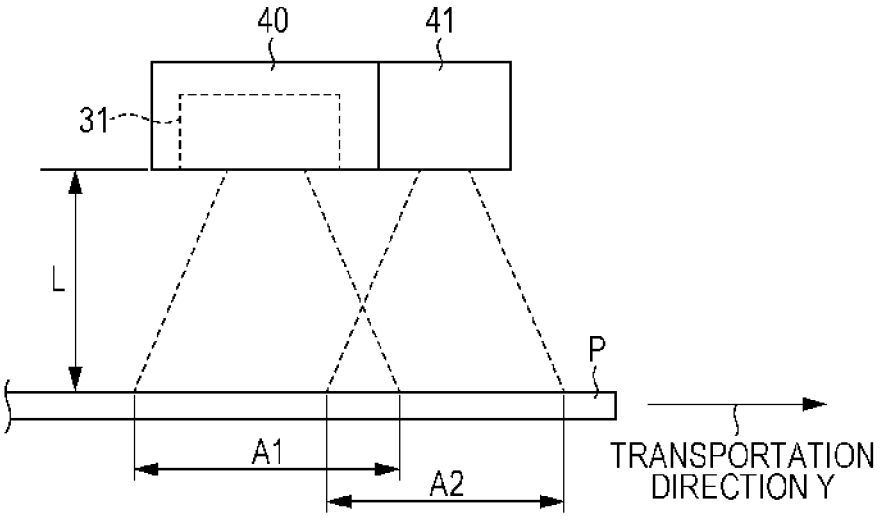
FIG. 5 schematically illustrates UV irradiation examples by the first irradiator and the second irradiator.
Figure 6:
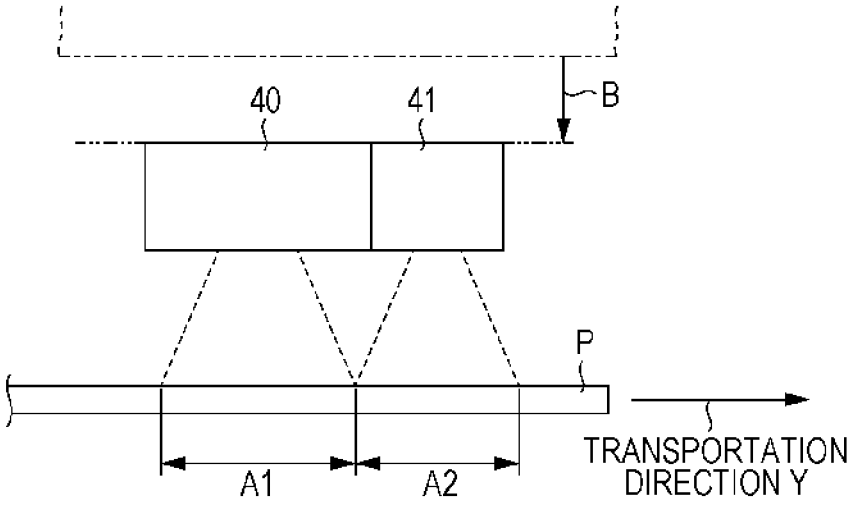
FIG. 6 schematically illustrates movement of the first irradiator and the second irradiator.

FIGS. 5 and 6 illustrate examples of movement of the first irradiator 40 and the second irradiator 41 when the relative positions of the irradiation ranges A1 and A2 on the medium P are defined as described above. As illustrated in FIG. 5, in a case where the distance L is excessively long, for example, the degree of overlapping between the irradiation ranges A1 and A2 on the medium P might increase. In this case, the first irradiator 40 and the second irradiator 41 are caused to approach the medium P in the variable gap direction B (i.e., downward in FIG. 6) on the basis of the distance L as illustrated in FIG. 6. With this movement, the irradiation ranges A1 and A2 slightly overlap and are substantially in contact with each other.

As described above, by defining the relative positions of the irradiation ranges A1 and A2 on the medium P on the basis of the distance L, it is possible to reduce an increase in the degree of overlapping between the irradiation ranges A1 and A2 and an increase in the distance between the irradiation ranges A1 and A2 on the medium P. Thus, a variation in the density of cured ink caused by an increased degree of overlapping or an increased distance can be reduced between the irradiation ranges A1 and A2 between a region showing such phenomena and a region showing no such phenomena.

In defining the relative positions of the irradiation ranges A1 and A2 on the medium P on the basis of the distance L, the first irradiator 40 and the second irradiator 41 do not need to move in the variable gap direction B, and only one of the first irradiator 40 or the second irradiator 41 may be moved. In such a case, a driving unit 44 capable of achieving such movement is employed. In moving the first irradiator 40 and the second irradiator 41 on the basis of the distance L, instead of movement of the first irradiator 40 and the second irradiator 41 in the same direction as described above, the first irradiator 40 and the second irradiator 41 may move in opposite directions. In such a case, a driving unit 44 capable of achieving such movement is employed. In defining the relative positions of the irradiation ranges A1 and A2 on the basis of the distance L, the amounts of movement of the first irradiator 40 and the second irradiator 41 in opposite directions on the basis of the distance L can be made smaller than those of movement of the first irradiator 40 and the second irradiator 41 in an identical direction.

With the embodiment described above, the following advantages can be obtained.

(1) When ink ejected onto the medium P is cured by irradiation with UV from the first irradiator 40 and the second irradiator 41, a variation in the density (banding) of the cured ink can be reduced.

(2) In the case of moving only one of the first irradiator 40 or the second irradiator 41 in the variable gap direction B so as to define the relative positions between the irradiation ranges A1 and A2 on the medium P on the basis of the distance L, movement of only the second irradiator 41 can reduce the influence on the glossiness of the cured ink on the medium P. This is because of the following reasons. Movement of the first irradiator 40 for precuring of ink on the medium P is likely to affect the glossiness of cured ink. Thus, to reduce the influence, it is preferable to move only the second irradiator 41.

Second Embodiment

A second embodiment showing a printer as an implementation of liquid ejecting apparatus will be described with reference to FIGS. 7 to 10.

In this embodiment, at least one of a first irradiator 40 or a second irradiator 41 is moved in a direction (i.e., the transportation direction Y) intersecting an ejection direction in which ink is ejected from a liquid ejecting head 31 onto a medium P so that the relative positions of irradiation ranges A1 and A2 on the medium P are changed. The direction in which at least one of the first irradiator 40 or the second irradiator 41 is moved in order to change the relative positions of the irradiation ranges A1 and A2 will be referred to as an approach/separation direction C in this embodiment.

Figure 7:
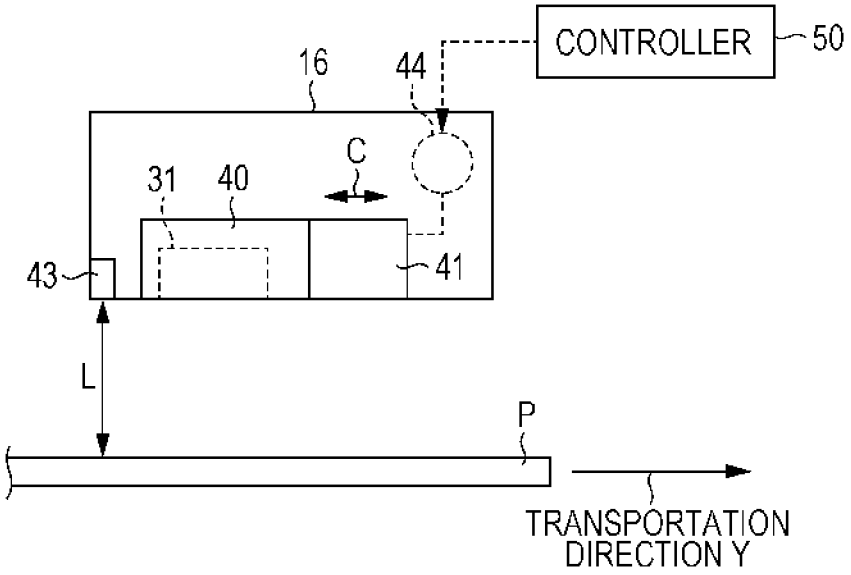
FIG. 7 schematically illustrates a configuration of the carriage.

FIG. 7 schematically illustrates a carriage 16 of this embodiment. A driving unit 44 provided in the carriage 16 has a mechanism that moves only the second irradiator 41, out of the first irradiator 40 and the second irradiator 41, in the approach/separation direction C. Specifically, the driving unit 44 includes a motor and a conversion mechanism that causes a driving force of the motor to act on the second irradiator 41 in the approach/separation direction. Thus, the second irradiator 41 can move relative to the first irradiator 40 in the approach/separation direction C through driving of the driving unit 44.

The controller 50 refers to a map on the basis of a distance L, obtains a driving instruction value of the driving unit 44, and on the basis of the driving instruction value, drives the driving unit 44 to move the second irradiator 41 in the approach/separation direction C. In this manner, the relative position of the second irradiator 41 relative to the first irradiator 40 in the approach/separation direction C is changed. By changing the relative position of the second irradiator 41 relative to the first irradiator 40 in the approach/separation direction C with the controller 50 as described above, the relative positions of the irradiation ranges A1 and A2 are defined such that the degree of overlapping between the irradiation ranges A1 and A2 and the distance between the irradiation ranges A1 and A2 of the first irradiator 40 and the second irradiator 41 do not increase. Thus, the driving instruction value obtained with reference to the map is used as a value for obtaining the relative positions of the irradiation ranges A1 and A2 at which the degree of overlapping between the irradiation ranges A1 and A2 and the distance between the irradiation ranges A1 and A2 do not increase.

Figure 8:
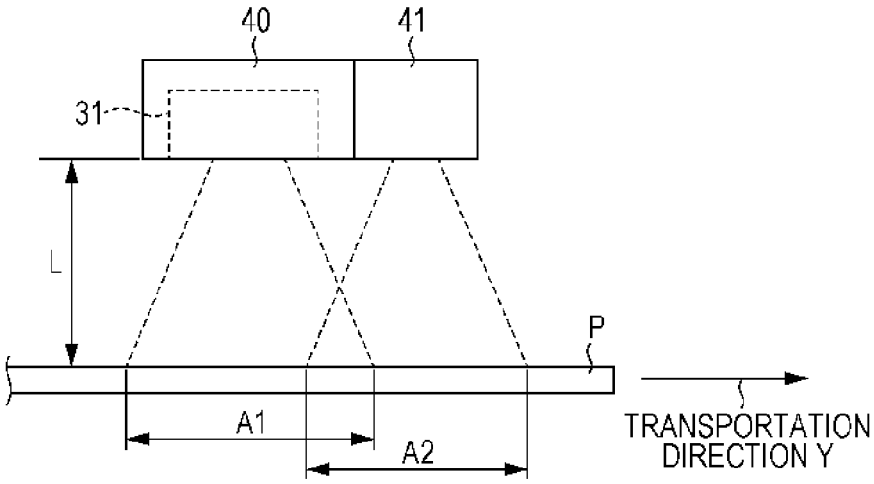
FIG. 8 schematically illustrates UV irradiation examples by the first irradiator and the second irradiator.
Figure 9:
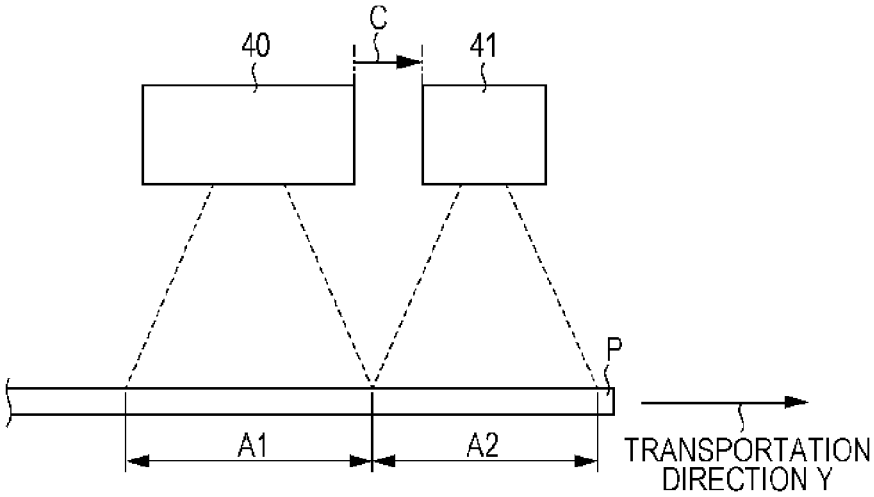
FIG. 9 schematically illustrates movement of the first irradiator and the second irradiator.

FIGS. 8 and 9 illustrate examples of relative movement of the first irradiator 40 and the second irradiator 41 in defining the relative positions of the irradiation ranges A1 and A2 on the medium P on the basis of the distance L as described above. As illustrated in FIG. 8, in a case where the distance L is excessively long, for example, the degree of overlapping between the irradiation ranges A1 and A2 on the medium P might increase. In this case, the second irradiator 41 is caused to move away from the first irradiator 40 in the approach/separation direction C (i.e., the lateral direction in FIG. 9) on the basis of the distance L as illustrated in FIG. 9. With this movement, the irradiation ranges A1 and A2 slightly overlap each other and are substantially in contact with each other.

In defining the relative positions of the irradiation ranges A1 and A2 on the medium P on the basis of the distance L, instead of moving only the second irradiator 41 in the approach/separation direction C, only the first irradiator 40 may be moved in the approach/separation direction C or the first irradiator 40 and the second irradiator 41 may be moved in opposite directions in the approach/separation direction C. In each of these cases, a driving unit 44 that can obtain such movement is employed. In defining the relative positions of the irradiation ranges A1 and A2 on the basis of the distance L, the amounts of movement of the first irradiator 40 and the second irradiator 41 in opposite directions in the approach/separation direction C can be made smaller than the amount of movement of only one of the first irradiator 40 or the second irradiator 41.

Figure 10:
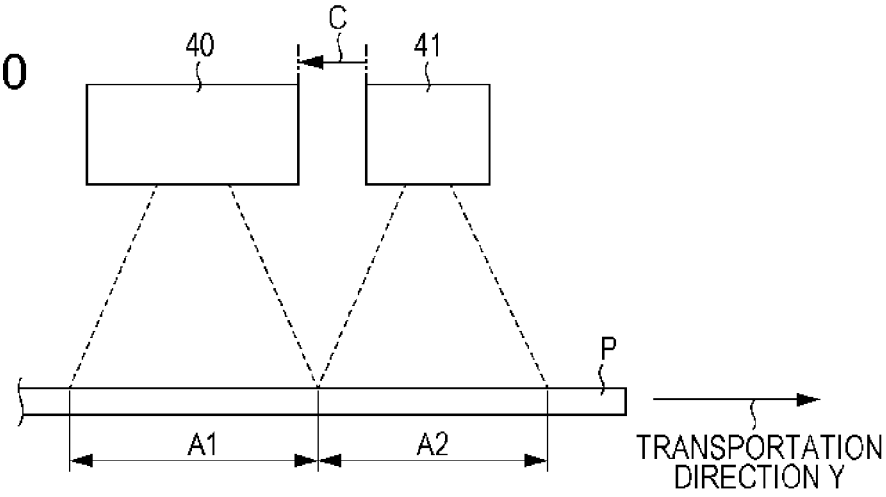
FIG. 10 schematically illustrates movement of the first irradiator and the second irradiator.

FIG. 10 illustrates another example of relative movement of the first irradiator 40 and the second irradiator 41 in defining the relative positions of the irradiation ranges A1 and A2 on the medium P on the basis of the distance L. In this example, in defining the relative positions of the irradiation ranges A1 and A2 on the medium P on the basis of the distance L, only the first irradiator 40 is moved in the approach/separation direction C.

In addition to advantage (1) of the first embodiment, the second embodiment can provide the following advantage:

(3) In relative movement of the first irradiator 40 and the second irradiator 41 in the approach/separation direction C, if the first irradiator 40 is moved in order to define the relative positions of the irradiation ranges A1 and A2 on the medium P on the basis of the distance L, this movement is likely to affect the glossiness of cured ink ejected on the medium P. However, moving only the second irradiator 41 in the approach/separation direction C in defining the relative positions of the irradiation ranges A1 and A2 on the medium P on the basis of the distance L can reduce the influence on the glossiness of cured ink on the medium P as described above.

Third Embodiment

A third embodiment showing a printer as an implementation of liquid ejecting apparatus will be described with reference to FIGS. 11 to 14.

In this embodiment, the directivity of at least one of the first irradiator 40 or the second irradiator 41 is adjusted so as to change the relative positions of the irradiation ranges A1 and A2 on the medium P.

Figure 11:
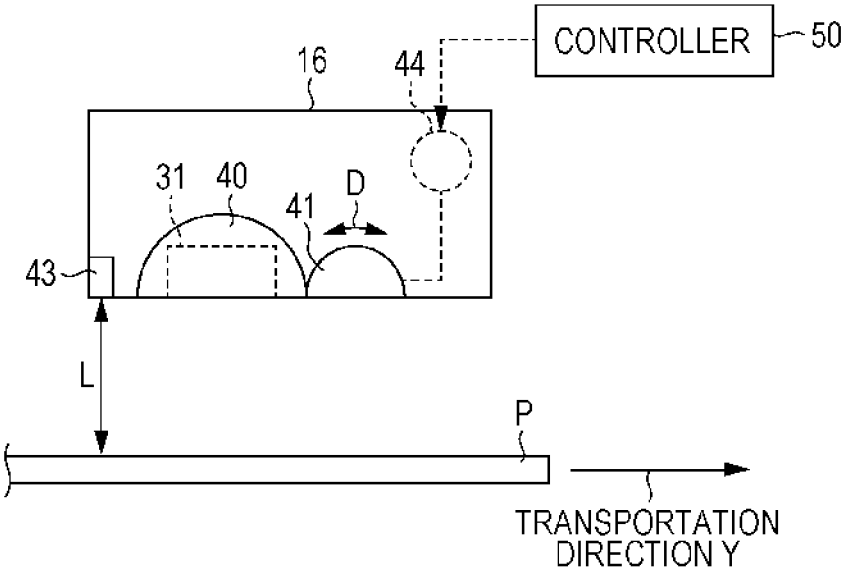
FIG. 11 schematically illustrates a configuration of the carriage.

FIG. 11 schematically illustrates a carriage 16 of this embodiment. A driving unit 44 provided in the carriage 16 includes a mechanism that adjusts directivity of the second irradiator 41, out of a first irradiator 40 and the second irradiator 41. Specifically, the driving unit 44 includes a motor and a conversion mechanism that causes a driving force of the motor to act on the second irradiator 41 in a rotation direction D in which the directivity of the second irradiator 41 is changed. The rotation direction D herein refers to a direction in which the second irradiator 41 is rotated such that the irradiation direction of the medium P with UV from the second irradiator 41 is changed along the transportation direction Y. Thus, through driving of the driving unit 44, rotation of the second irradiator 41 in the rotation direction D, i.e., the directivity of the second irradiator 41, can be changed. The change in directivity of the second irradiator 41 as described above changes the UV irradiation direction along the transportation direction Y with a variation in irradiation angle of the medium P with UV from the second irradiator 41.

The controller 50 refers to a map on the basis of a distance L, obtains a driving instruction value of the driving unit 44, and on the basis of the driving instruction value, drives the driving unit 44 to adjust the directivity of the second irradiator 41, thereby changing the irradiation angle of the medium P with UV from the second irradiator 41. By changing the UV irradiation angle from the second irradiator 41 by the controller 50 as described above, the relative positions of the irradiation ranges A1 and A2 are obtained such that the degree of overlapping between the irradiation ranges A1 and A2 and the distance between the irradiation ranges A1 and A2 of the first irradiator 40 and the second irradiator 41 do not increase. Thus, the driving instruction value obtained with reference to the map is used as a value for obtaining the relative positions of the irradiation ranges A1 and A2 at which the degree of overlapping between the irradiation ranges A1 and A2 and the distance between the irradiation ranges A1 and A2 do not increase.

Figure 12:
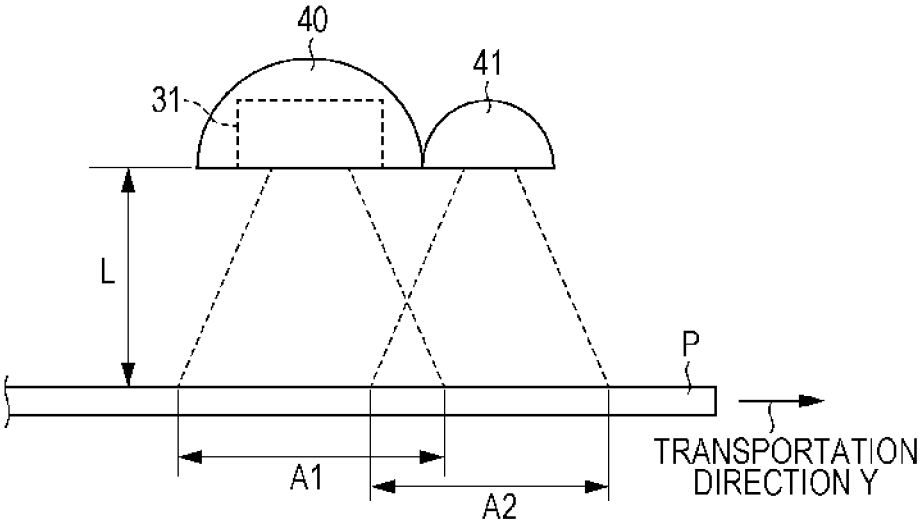
FIG. 12 schematically illustrates movement of the first irradiator and the second irradiator.
Figure 13:
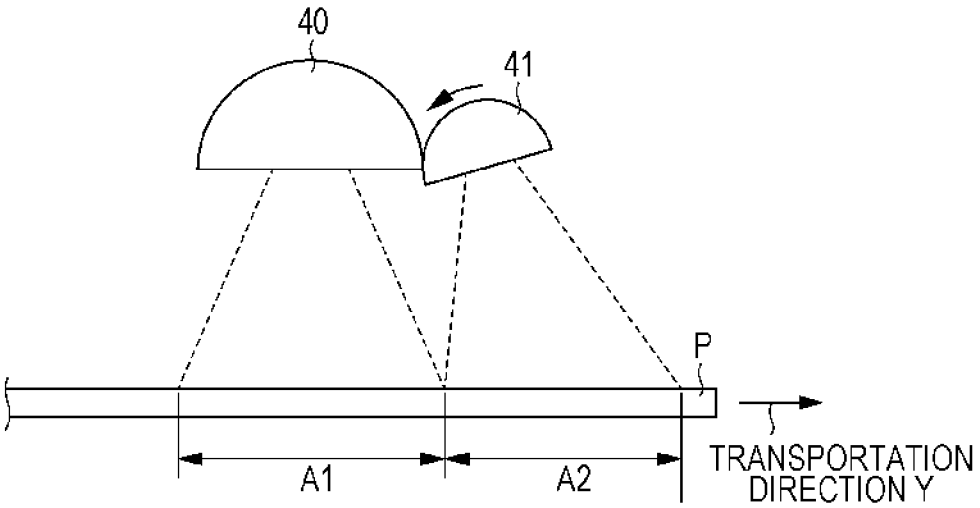
FIG. 13 schematically illustrates movement of the first irradiator and the second irradiator.

FIGS. 12 and 13 illustrate examples of directivity adjustment of at least one of the first irradiator 40 or the second irradiator 41 (e.g., only the second irradiator 41 in these examples) in defining the relative positions of the irradiation ranges A1 and A2 on the medium P on the basis of the distance L as described above. As illustrated in FIG. 12, in a case where the distance L is excessively long, for example, the degree of overlapping between the irradiation ranges A1 and A2 on the medium P might increase. In this case, the directivity of the second irradiator 41 is adjusted as illustrated in FIG. 13 on the basis of the distance L. With this adjustment, the irradiation ranges A1 and A2 slightly overlap each other and are substantially in contact with each other.

In defining the relative positions of the irradiation ranges A1 and A2 on the medium P on the basis of the distance L, instead of adjusting directivity of the second irradiator 41, directivity of the first irradiator 40 may be adjusted or directivities of both of the first irradiator 40 and the second irradiator 41 may be individually adjusted. In each of these cases, a driving unit 44 that can obtain such movement is employed. In defining the relative positions of the irradiation ranges A1 and A2 on the basis of the distance L, the amounts of directivity adjustment of the first irradiator 40 and the second irradiator 41 can be made smaller than that of directivity adjustment of only one of the first irradiator 40 or the second irradiator 41.

Figure 14:
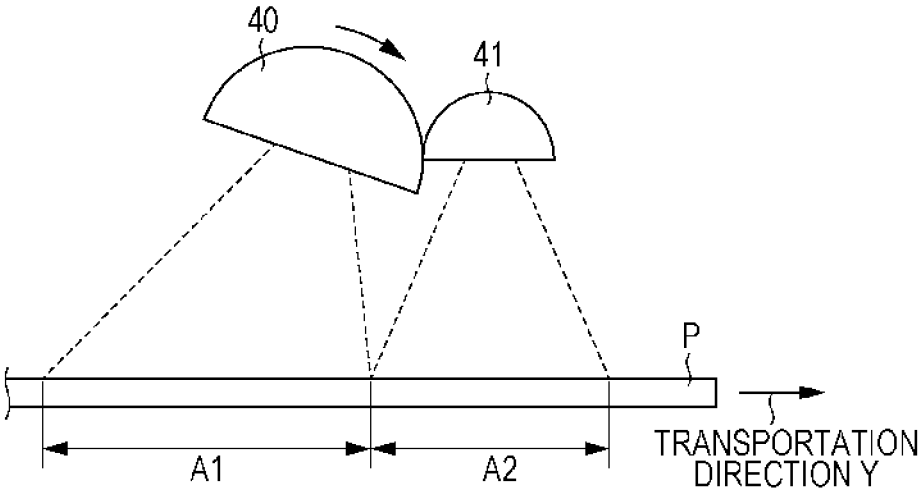
FIG. 14 schematically illustrates movement of the first irradiator and the second irradiator.

FIG. 14 illustrates another example of directivity adjustment of at least one of the first irradiator 40 or the second irradiator 41 in defining the relative positions of the irradiation ranges A1 and A2 on the medium P on the basis of the distance L. In this example, directivity of the first irradiator 40 is adjusted in defining the relative positions of the irradiation ranges A1 and A2 on the medium P on the basis of the distance L.

In addition to advantage (1) of the first embodiment, the third embodiment can provide the following advantage:

(4) In adjusting directivity of at least one of the first irradiator 40 and the second irradiator 41 in order to define the relative positions of the irradiation ranges A1 and A2 on the medium P on the basis of the distance L, adjustment of directivity of the first irradiator 40 is likely to affect the glossiness of cured ink ejected on the medium P. However, directivity adjustment of only the second irradiator 41 in defining the relative positions of the irradiation ranges A1 and A2 on the medium P on the basis of the distance L can reduce the influence on the glossiness of cured ink on the medium P as described above.

Fourth Embodiment

A fourth embodiment showing a printer as an implementation of liquid ejecting apparatus will be described with reference to FIGS. 15 to 17.

In this embodiment, a light-emission region of at least one of a first irradiator 40 or a second irradiator 41 is adjusted so as to change the relative positions of irradiation ranges A1 and A2 on a medium P.

Figure 15:
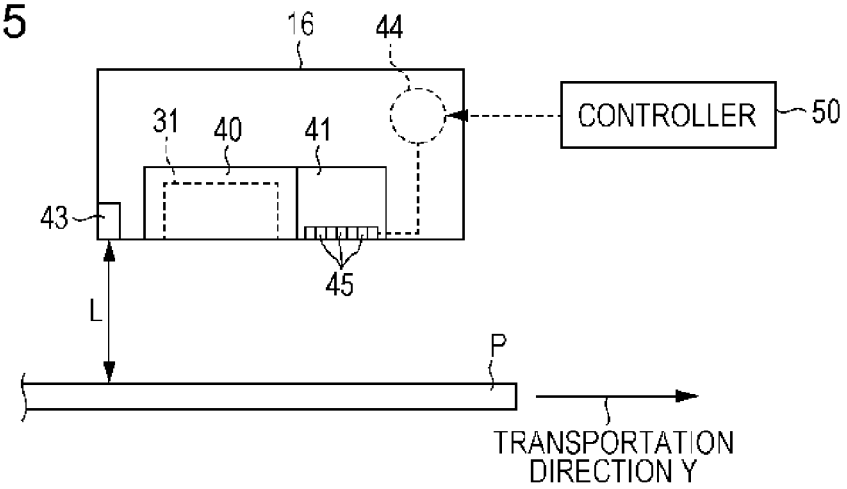
FIG. 15 schematically illustrates a configuration of the carriage.

FIG. 15 schematically illustrates a carriage 16 of this embodiment. A driving unit 44 provided in the carriage 16 has a mechanism that adjusts the light-emission region of the second irradiator 41, out of the first irradiator 40 and the second irradiator 41. Specifically, the second irradiator 41 includes a plurality of light-emitting units 45 such as UV-LEDs, and emits UV to the medium P through light emission of the light-emitting units 45. The driving unit 44 adjusts the light-emission region of the second irradiator 41 by changing the number of light emissions of the light-emitting units 45.

The controller 50 refers to a map on the basis of a distance L, obtains a driving instruction value of the driving unit 44, and on the basis of the driving instruction value, drives the driving unit 44 to adjust the light-emission region of the second irradiator 41. By changing the light-emission region of the second irradiator 41 with the controller 50 as described above, the relative positions of the irradiation ranges A1 and A2 are defined such that the degree of overlapping between the irradiation ranges A1 and A2 and the distance between the irradiation ranges A1 and A2 of the first irradiator 40 and the second irradiator 41 do not increase. Thus, the driving instruction value obtained with reference to the map is used as a value for obtaining the relative positions of the irradiation ranges A1 and A2 at which the degree of overlapping between the irradiation ranges A1 and A2 and the distance between the irradiation ranges A1 and A2 do not increase.

Figure 16:
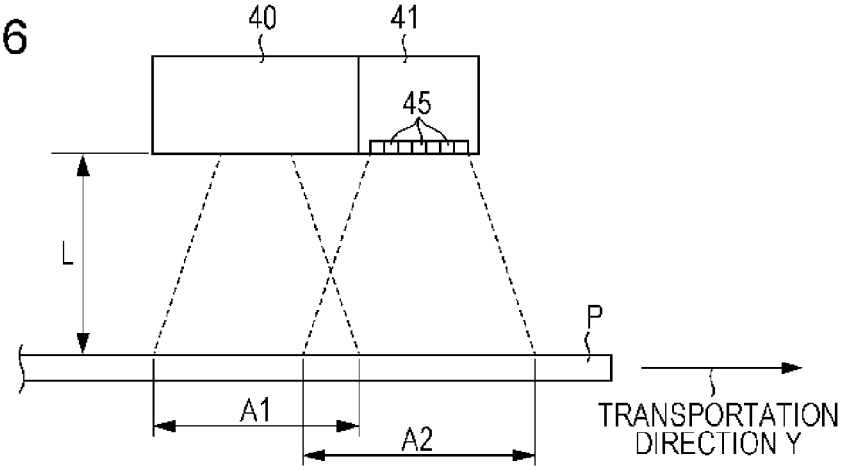
FIG. 16 schematically illustrates movement of the first irradiator and the second irradiator.
Figure 17:
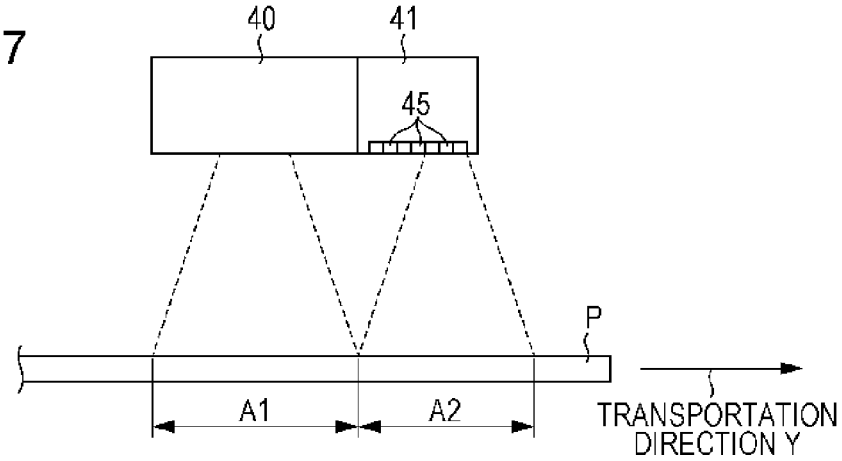
FIG. 17 schematically illustrates movement of the first irradiator and the second irradiator.

FIGS. 16 and 17 illustrate examples of adjustment of the light-emission region of at least one of the first irradiator 40 or the second irradiator 41 (e.g., only the second irradiator 41 in these examples) in defining the relative positions of the irradiation ranges A1 and A2 on the medium P on the basis of a distance L as described above. As illustrated in FIG. 16, in a case where the distance L is excessively long, for example, the degree of overlapping between the irradiation ranges A1 and A2 on the medium P might increase. In this case, the light-emission region of the second irradiator 41 is adjusted on the basis of the distance L as illustrated in FIG. 17. With this adjustment, the irradiation ranges A1 and A2 slightly overlap each other and are substantially in contact with each other.

In defining the relative positions of the irradiation ranges A1 and A2 on the medium P on the basis of the distance L, instead of adjusting the light-emission region of the second irradiator 41, the light-emission region of the first irradiator 40 may be changed or the light-emission regions of both of the first irradiator 40 and the second irradiator 41 may be individually adjusted. In each of these cases, a driving unit 44 that can obtain such adjustment of the light-emission region(s) is employed. In the case of adjusting the light-emission region of the first irradiator 40, a plurality of light-emitting units are also provided in the first irradiator 40 in a manner similar to the light-emitting units 45 in the second irradiator 41.

In addition to advantage (1) of the first embodiment, the fourth embodiment can provide the following advantage:

(4) In adjusting the light-emission region of at least one of the first irradiator 40 or the second irradiator 41 in order to define the relative positions of the irradiation ranges A1 and A2 on the medium P on the basis of the distance L, adjustment of the light-emission region of the first irradiator 40 is likely to affect the glossiness of cured ink ejected on the medium P. However, adjustment of the light-emission region of only the second irradiator 41 in defining the relative positions of the irradiation ranges A1 and A2 on the medium P on the basis of the distance L can reduce the influence on the glossiness of cured ink on the medium P.

Other Embodiments

The foregoing embodiments may be modified as follows.

Figure 18:
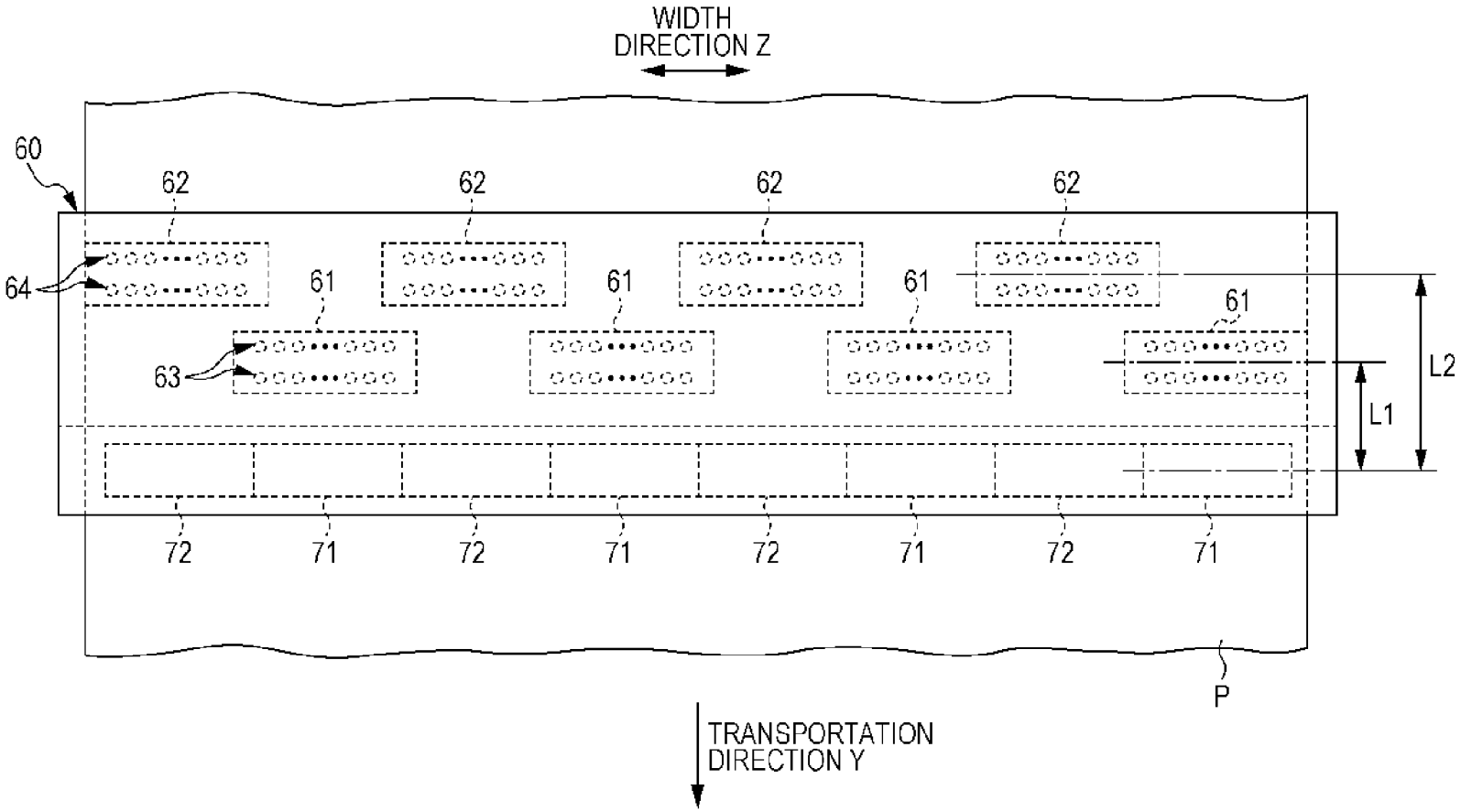
FIG. 18 schematically illustrates a positional relationship between a liquid ejecting head and an irradiator in a variation.
Figure 19:
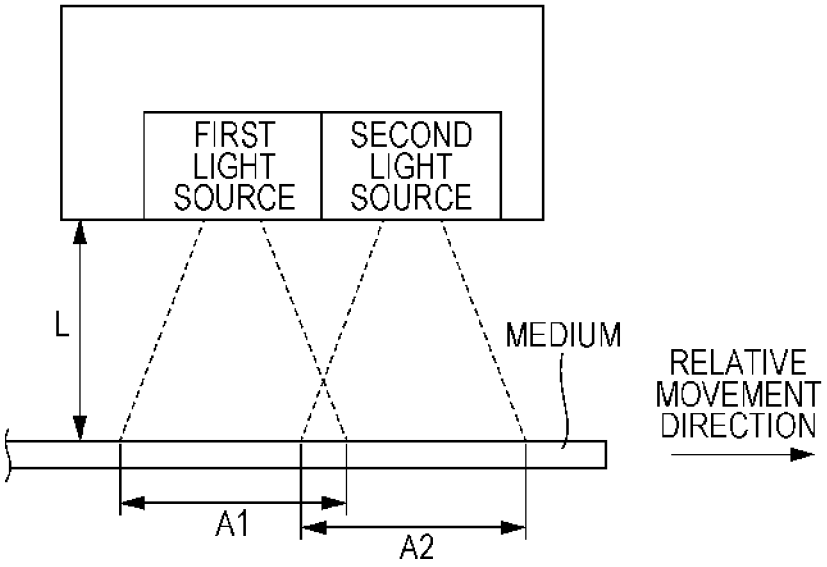
FIG. 19 schematically illustrates a relationship between the distance from a medium to the liquid ejecting head and relative positions of irradiation ranges irradiated with light from a first light source and a second light source.
Figure 20:
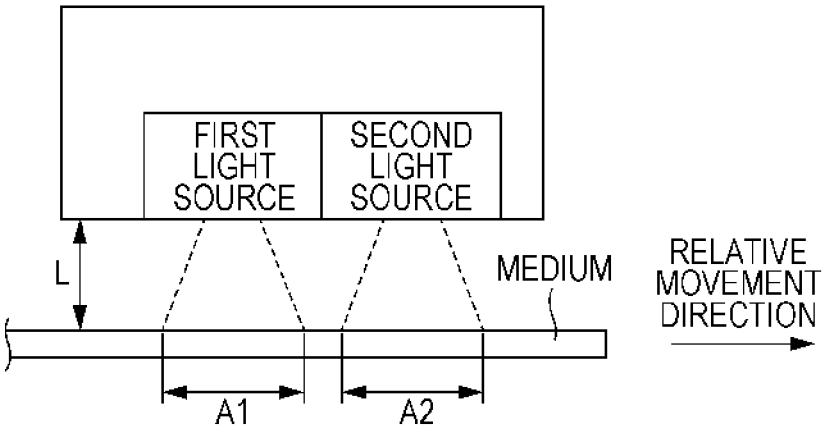
FIG. 20 schematically illustrates a relationship between the distance from the medium to the liquid ejecting head and the relative positions of the irradiation ranges irradiated with light from the first light source and the second light source.

As illustrated in FIG. 18, the printer 11 may be a printer with a line scan head including a fixed liquid ejecting unit 60 instead of the carriage 16 that reciprocates in the scanning direction X. In this case, the liquid ejecting unit 60 preferably includes: a plurality of liquid ejecting heads 61 and 62 whose nozzle rows 63 and 64 are continuously arranged along a width direction Z of the medium P orthogonal to the transportation direction Y of the medium P; and a plurality of irradiators 71 and 72 that can apply UV onto ink ejected onto the medium P by the liquid ejecting heads 61 and 62. In the liquid ejecting unit 60, the first liquid ejecting head 61 is preferably adjacent to the second liquid ejecting head 62 in the width direction Z and located downstream of the second liquid ejecting head 62 in the transportation direction Y, and the first irradiator 71 and the second irradiator 72 are preferably adjacent to each other in the width direction Z and located downstream of the first liquid ejecting head 61 and the second liquid ejecting head 62 in the transportation direction Y. The distance L1 from the first irradiator 71 to the first liquid ejecting head 61 is preferably smaller than the distance L2 from the second irradiator 72 to the second liquid ejecting head 62. The medium P is relatively transported in the transportation direction Y relative to the fixed liquid ejecting unit 60 through driving of the feeding motor 14 so that the liquid ejecting unit 60 moves relative to the medium P in the direction opposite to the transportation direction Y.

In the liquid ejecting unit 60 illustrated in FIG. 18, the first liquid ejecting head 61 and the second liquid ejecting head 62 eject ink onto the transported medium P, and the ink ejected onto the medium P is irradiated with UV from the first irradiator 71 and the second irradiator 72, thereby performing printing. The medium P is irradiated with UV from the first irradiator 71 and the second irradiator 72 at different locations in the width direction Z. As described above, the width direction Z intersects (is orthogonal to) the transportation direction Y, and intersects the ejection direction in which ins is ejected onto the medium P from the first liquid ejecting head 61 and the second liquid ejecting head 62.

In the printer illustrated in FIG. 18, printing may be performed such that the medium P is moved in the transportation direction Y and the liquid ejecting unit 60 is moved in the direction opposite to the transportation direction Y. That is, both of the medium P and the liquid ejecting unit 60 may be moved. In this case, a drive source that causes the liquid ejecting unit 60 to move in the direction opposite to the transportation direction Y is preferably provided.

In the first embodiment, the carriage 16 itself may be moved in the variable gap direction B so that the first irradiator 40 and the second irradiator 41 can be moved in the variable gap direction B.

In the first embodiment, the relative positions of the irradiation ranges A1 and A2 may be changed by fixing the first irradiator 40 and the second irradiator 41 relative to the carriage 16 and moving the support 13 in the variable gap direction B on the basis of the distance L.

In the foregoing description, the distance L is obtained on the basis of the detection signal from the distance sensor 43. Alternatively, the distance L may be obtained on the basis of information such as a medium type acquired from the acquisition unit 52.

In defining the relative positions of the irradiation ranges A1 and A2 on the basis of the distance L, movement (or adjustment) of the first irradiator 40 and the second irradiator 41 in at least two of the first through fourth embodiments may be combined.

In the foregoing description, the UV-LEDs are employed as an example of the light-emitting units of the first irradiator 40 and the second irradiator 41. Alternatively, other types of light-emitting units may be employed. Examples of such light-emitting units include metal halide lamps and mercury lamps.

Ink to be ejected onto the medium P may be of a type that is cured under irradiation with light except UV.

The printer 11 may eject photo-curing liquid except ink onto the medium P.

The liquid ejecting apparatus may be applied to apparatus except a printer.

In this case, examples of liquid to be ejected by the liquid ejecting apparatus include liquid with high viscosity, liquid with low viscosity, sol, gel water, other inorganic solvents, organic solvents, solutions, liquid resins, and liquid metals (metallic melts). Examples of liquid may include not only a liquid state of a material but also a state in which particles of a functional material in a solid state such as pigments or metal particles are dissolved, dispersed, or mixed in a solvent.

Examples of the liquid ejecting apparatus include apparatus that ejects liquid including a dispersed or dissolved electrode material or color material, for example, for use in manufacture of devices such as liquid-crystal displays, electroluminescent (EL) displays, surface-emitting displays, and color filters. Examples of the liquid ejecting apparatus also include apparatus that ejects a biological organic material for use in manufacture of biochips, apparatus that ejects liquid for samples to be used as precision pipets, printing apparatus, and microdispensers. Examples of the liquid ejecting apparatus further include apparatus that ejects, onto a substrate, a transparent resin solution such as a UV-curing resin in order to form minute hemisphere lenses (optical lenses) for use in, for example, optical communication devices, and apparatus that ejects, for example, acid or alkaline etchant in order to etch a substrate or other components.

The entire disclosure of Japanese Patent Application No. 2013-227951, filed Nov. 1, 2013 is expressly incorporated by reference herein.

What is claimed is:

1. A liquid ejecting apparatus comprising:

a liquid ejecting head that ejects photo-curing liquid;

a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations; and a controller that changes relative positions of a first light irradiation range on the medium irradiated with light from the first light source and a second light irradiation range on the medium irradiated with light from the second light source, on the basis of a distance from the medium to the first light source and the second light source in the ejection direction, wherein changing the relative positions of the first and second light irradiation ranges on the medium substantially reduces any overlap between the first and second light irradiation ranges.

2. The liquid ejecting apparatus of claim 1 further comprising:

a driving unit that moves at least one of the first light source or the second light source in the ejection direction, wherein the controller drives the driving unit on the basis of a distance from the medium to the first light source and the second light source in the ejection direction so that a position of the at least one of the first light source or the second light source relative to the medium in the ejection direction is changed, thereby changing relative positions of the irradiation ranges on the medium.

3. The liquid ejecting apparatus of claim 1 further comprising:

a driving unit that moves at least one of the first light source or the second light source in a direction intersecting the ejection direction, wherein the controller drives the driving unit on the basis of a distance from the medium to the first light source and the second light source in the ejection direction so that a distance between the first light source and the second light source in the direction intersecting the ejection direction is changed, thereby changing relative positions of the irradiation ranges on the medium wherein changing the position of the at least one of the first or second light sources substantially reduces any overlap between the first and second light irradiation ranges.

4. The liquid ejecting apparatus of claim 1 further comprising:

a driving unit that adjusts directivity of at least one of the first light source or the second light source, wherein the controller drives the driving unit on the basis of a distance from the medium to the first light source and the second light source in the ejection direction so that a light application angle of the at least one of the first light source or the second light source is changed, thereby changing relative positions of the irradiation ranges on the medium wherein changing the position of the at least one of the first or second light sources substantially reduces any overlap between the first and second light irradiation ranges.

5. The liquid ejecting apparatus of claim 1 further comprising:

a driving unit that adjusts light emission of at least one of the first light source or the second light source, wherein the controller drives the driving unit on the basis of a distance from the medium to the first light source and the second light source in the ejection direction so that a light-emission region of the at least one of the first light source or the second light source is changed, thereby changing relative positions of the irradiation ranges on the medium wherein changing the position of the at least one of the first or second light sources substantially reduces any overlap between the first and second light irradiation ranges.

6. A liquid ejecting apparatus comprising:

a liquid ejecting head that ejects photo-curing liquid;

a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations;

a driving unit that moves at least one of the first light source or the second light source in the ejection direction; and a controller that drives the driving unit on the basis of a distance from the medium to the first light source and the second light source in the ejection direction, thereby changing a position of the at least one of the first light source or the second light source relative to the medium in the ejection direction, wherein changing the position of the at least one of the first or second light sources substantially reduces any overlap between first and second light irradiation ranges on the medium generated by the first and second light sources.

7. A liquid ejecting apparatus comprising:

a liquid ejecting head that ejects photo-curing liquid;

a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations;

a driving unit that moves at least one of the first light source or the second light source in the direction intersecting the ejection direction; and a controller that drives the driving unit on the basis of a distance from the medium to the first light source and the second light source in the ejection direction, thereby changing a distance between the first light source and the second light source in the direction intersecting the ejection direction.

8. A liquid ejecting apparatus comprising:

a liquid ejecting head that ejects photo-curing liquid;

a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations;

a driving unit that adjusts directivity of at least one of the first light source or the second light source; and a controller that drives the driving unit on the basis of a distance from the medium to the first light source and the second light source in the ejection direction, thereby changing a light application angle of the at least one of the first light source or the second light source.

9. A liquid ejecting apparatus comprising:

a liquid ejecting head that ejects photo-curing liquid;

a first light source and a second light source each of which moves relative to a medium onto which the liquid has been ejected from the liquid ejecting head in a direction intersecting an ejection direction in which the liquid is ejected, the medium being irradiated with light from the first light source and the second light source at different locations;

a driving unit that adjusts light emission of at least one of the first light source or the second light source; and a controller that drives the driving unit on the basis of a distance from the medium to the first light source and the second light source in the ejection direction, thereby changing a light-emission region of the at least one of the first light source or the second light source.

* * * * *